US006564022B2

(12) United States Patent
Tamura et al.

(10) Patent No.: US 6,564,022 B2
(45) Date of Patent: May 13, 2003

(54) IMAGE FORMING APPARATUS

(75) Inventors: Nobuyasu Tamura, Tokyo (JP); Yutaka Miyasaka, Tokyo (JP); Kimio Nishizawa, Tokyo (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 09/927,924

(22) Filed: Aug. 10, 2001

(65) Prior Publication Data

US 2002/0041768 A1 Apr. 11, 2002

(30) Foreign Application Priority Data

Aug. 16, 2000 (JP) ..... 2000-246690

(51) Int. Cl.[7] ..... G03G 15/00
(52) U.S. Cl. ..... 399/49; 399/222
(58) Field of Search ..... 399/49, 53, 252, 399/236, 222

(56) References Cited

U.S. PATENT DOCUMENTS 5,666,588 A * 9/1997 Uchiyama et al. ..... 399/44
6,226,466 B1 * 5/2001 Ojima et al. ..... 399/49
6,285,841 B1 * 9/2001 Miho ..... 399/55
6,353,716 B1 * 3/2002 Uehara et al. ..... 399/44

FOREIGN PATENT DOCUMENTS

EP 432 476 A2 * 6/1991

* cited by examiner

*Primary Examiner*—Quana M. Grainger
(74) *Attorney, Agent, or Firm*—Frishauf, Holtz, Goodman & Chick, P.C.

(57) ABSTRACT

An image forming apparatus includes an image carrier on which a latent image is formed; and a developing roller provided in the vicinity of a surface of the image carrier for conveying a two-component developer to develop the latent image, wherein the following conditional inequality (1) is satisfied, $1<(Vs/Vp)\leqq(Dsd/Dws)\times 0.129$ . . . (1) where Vs/Vp represents a relative velocity of the developing roller to the image carrier, Dsd ($\mu$m) represents a distance between the surface of the image carrier and a surface of the developing roller, and Dws (mg/cm$^2$) represents an amount of the developer which has been held and conveyed by the developing roller.

14 Claims, 4 Drawing Sheets

IMAGE FORMING APPARATUS

BACKGROUND OF THE INVENTION

The present invention relates to an image forming apparatus in which a rubbed image or an excessive edge effect can be repressed.

There has been known an image forming apparatus wherein two-component developing agents containing toner powder and carriers are attracted to the circumference of a developing roller by magnetic force, through charging of the developing roller in accordance with an image to be formed, and the developing roller is pressed against a transfer sheet representing an image carrier so that a toner image may be formed on the transfer sheet.

Incidentally, since developing agents adhering to the circumference of a developing roller are attracted to the circumferential surface of the developing roller by magnetic force, the developing agents are sometimes extended from the circumferential surface in the radial direction of the developing roller to be in a shape of a thorn, like iron sand. This is called a brush of developing agents. When the brush of developing agents is formed, it is feared that a toner image (especially, a trailing edge of the image) is scraped off by the tip of the brush, which causes deterioration of image quality such as a rubbed image on a trailing edge of the image. Further, the developing agents held at a position of the developing roller facing a non-image area where no latent image is formed on an image carrier are sucked electrostatically by voltage on the end portion of a latent image on the image carrier, and thereby, developing agents in quantity of more than necessary are attracted to an end portion of the latent image, resulting in a phenomenon wherein an edge of the image is emphasized. In recent years, in particular, there is a strong demand for a color image and an image of high image quality, and factors to deteriorate image quality need to be removed as far as possible.

SUMMARY OF THE INVENTION

In view of the problems in prior art stated above, an object of the invention is to provide an image forming apparatus in which a rubbed image or an excessive edge effect can be repressed.

To attain the object mentioned above, an image forming apparatus of the First Structure is represented by an image forming apparatus for conducting development by making two-component developing agents held by a developing roller to touch an image carrier, wherein the following expression holds with respect to relative velocity of the developing roller to the image carrier (Vs/Vp), a distance between the image carrier to the developing roller (Dsd ($\mu$m)) and an amount of conveyed developing agents on the developing roller (Dws (mg/cm$^2$)), $$1<(Vs/Vp)\leqq(Dsd/Dws)\times 0.129 \quad (1)$$

An image forming apparatus of the Second Structure is represented by an image forming apparatus for conducting development by making two-component developing agents held by a developing roller to touch an image carrier, wherein at least one or several patch images each having different density are prepared on the image carrier, patch scan data obtained by scanning image patch density in the direction of image advancing for the patch images prepared are detected, and the first image density data within a prescribed range of the central portion of the patch and the second image density data within a prescribed range on the rear end portion of the patch are calculated, and when an edge on the rear end portion on the patch is judged to be an excessive edge effect or to be a rubbed image based on the first image density data within a prescribed range of the central portion of the patch and on the second image density data within a prescribed range on the rear end portion of the patch, the relative velocity of the developing roller to the image carrier (Vs/Vp) is controlled so that, the second image density data within a prescribed range on the rear end portion of the patch may be within a prescribed density range for the first image density data within a prescribed range of the central portion of the patch.

FIG. 1 is a diagram showing the relationship between a distance from an image carrier to a developing roller (Dsd ($\mu$m)) and an amount of conveyed developing agents on the developing roller (Dws (mg/cm$^2$)). In virtue of the studies by the inventors of the invention, it has been cleared that the greater a distance between an image carrier and a developing roller, namely a clearance (Dsd) is as shown in FIG. 1, the lower a possibility that an image is scraped off by a brush of developing agents is, because a length of the brush of developing agents is limited, and thereby, image quality is improved. It has further been cleared that, when an amount of conveyed developing agents on the developing roller (Dws) is make to be greater, image quality is lowered because a brush of developing agents tends to be high.

It has been cleared, on the other hand, that when the relative velocity of the developing roller to the image carrier (Vs/Vp) is made to be greater, image quality tends to worsened even when each of the distance between the image carrier and the developing roller (Dsd ($\mu$m)) and an amount of conveyed developing agents on the developing roller (Dws) stays to be the same.

The relationship of the foregoing is expressed as follows by the following expression;

$$((Vs/Vp)\times Dws)/Dsd=a \quad (1)$$

wherein, "a" is a constant.

The inventors of the invention obtained the constant "a" through tests.

(Test Conditions)

Two-component developing agents (toner: particle size 5–10 $\mu$m+carrier: particle size 40–100 $\mu$m, magnetization amount 30–60 emu/g)

Toner concentration: 4–8%

Charging amount: 10–50 $\mu$C/g

Apparent density: 1.5–2.0 g/cm$^2$

Under the conditions mentioned above, a scratchy rubbed image on the rear end portion was evaluated visually by changing Dws, Dsd and Vs/Vp, and results shown in Table 1 were obtained. In the table, A shows the result that no rubbed image was observed, B shows the result that a rubbed image was observed and C shows none of A and B.

TABLE 1

| | For Vs/Vp: 1.25 | | |
|---|---|---|---|
| 60 | B | C | A |
| 50 | C | A | A |
| 40 | A | A | A |
| 30 | A | A | A |
| 20 | A | A | A |
| Dws/Dsd | 400 | 500 | 600 |

TABLE 1-continued

| | | | |
|---|---|---|---|
| | For Vs/Vp: 1.55 | | |
| 60 | B | B | C |
| 50 | B | C | A |
| 40 | C | A | A |
| 30 | A | A | A |
| 20 | A | A | A |
| Dws/ Dsd[001b] | 400 | 500 | 600 |
| | For Vs/Vp: 1.85 | | |
| 60 | B | B | B |
| 50 | B | B | C |
| 40 | B | C | A |
| 30 | C | A | A |
| 20 | A | A | A |
| Dws/Dsd | 400 | 500 | 600 |

Since it has been cleared from the results of the tests that a=0.129 is a limit for occurrence of a rubbed image, the expression (1) ((Vs/Vp)×Dws)/Dsd=a can be expressed as follows.

$$((Vs/Vp)\times Dws)/Dsd=0.129 \quad (1')$$

Since it is known that an image noise is increased when Vs/Vp is made to be 1 or less, the following expression (2) is obtained from the foregoing and expression (1').

$$1<(Vs/Vp)\leqq(Dsd/Dws)\times 0.129 \quad (2)$$

Namely, as set forth in the image forming apparatus of the First Structure of the present invention, it has been made known that image quality can be kept to be high when the relationship of the expression (2) holds with respect to relative velocity of the developing roller to the image carrier (Vs/Vp), a distance between the image carrier to the developing roller (Dsd (μm)) and an amount of conveyed developing agents on the developing roller (Dws (mg/cm$^2$)).

In particular, a rubbed image caused by a brush of developing agents appears clearly on a halftone portion of an image. Therefore, it is extremely effective to make the relationship of the expression (2) to hold for keeping image quality in the case of forming an image on a high image quality mode, when an image forming apparatus has a high image quality mode for developing a highly detailed image such as a photograph.

Further, an amount of conveyed developing agents varies depending on a distance for the developing roller to slide. Therefore, the amount of conveyed developing agents can be controlled, without obtaining directly the amount of conveyed developing agents, if the distance for the developing roller to slide is measured integrally and the amount of conveyed developing agents (Dws) is determined based on the sliding distance measured integrally. Incidentally, if the relationship between a sliding distance of the developing roller and the amount of conveyed developing agents is obtained on a test basis, for example, to be stored in a non-volatile memory as a table, it is possible to obtain an amount of conveyed developing agents immediately from the table, if the sliding distance at the present time is known.

Further, an amount of conveyed developing agents varies depending also on a change of ambient temperature and humidity. Therefore, the amount of conveyed developing agents can be controlled, without obtaining directly the amount of conveyed developing agents, if at least one of the ambient temperature and humidity is detected and the amount of conveyed developing agents (Dws) is determined based on at least one of the detected ambient temperature and humidity Incidentally, if the relationship between an ambient temperature and humidity and the amount of conveyed developing agents is obtained on a test basis, for example, to be stored in a non-volatile memory as a table, it is possible to obtain an amount of conveyed developing agents immediately from the table, if the ambient temperature or humidity at the present time is known.

An image forming apparatus of the Second Structure is represented by an image forming apparatus for conducting development by making two-component developing agents held by a developing roller to touch an image carrier, wherein at least one or several patch images each having different density are prepared on the image carrier, patch scan data obtained by scanning image patch density in the direction of image advancing for the patch images prepared are detected, and the first image density data within a prescribed range of the central portion of the patch and the second image density data within a prescribed range on the rear end portion of the patch are calculated from the patch scan data, and when an edge on the rear end portion on the patch is judged to be emphasized or to be scratchy based on the first image density data within a prescribed range of the central portion of the patch and on the second image density data within a prescribed range on the rear end portion of the patch, the relative velocity of the developing roller to the image carrier (Vs/Vp) is controlled so that, the second image density data within a prescribed range on the rear end portion of the patch may be within a prescribed density range for the first image density data within a prescribed range of the central portion of the patch, and thereby, image quality can be adjusted automatically, which is an advantage that no time is taken for adjustment.

It is further possible to conduct control of developing AC frequency or developing AC bias in place of the control of the relative velocity of the developing roller to the image carrier (Vs/Vp).

It is preferable that image density data within a prescribed range on a central portion of the patch are detected as third image density data after the aforesaid control, and feed back control is conducted for developing DC bias or an exposure value.

DETAILED DESCRIPTION OF THE PREFERRED EMBODIMENT

Figure 1:
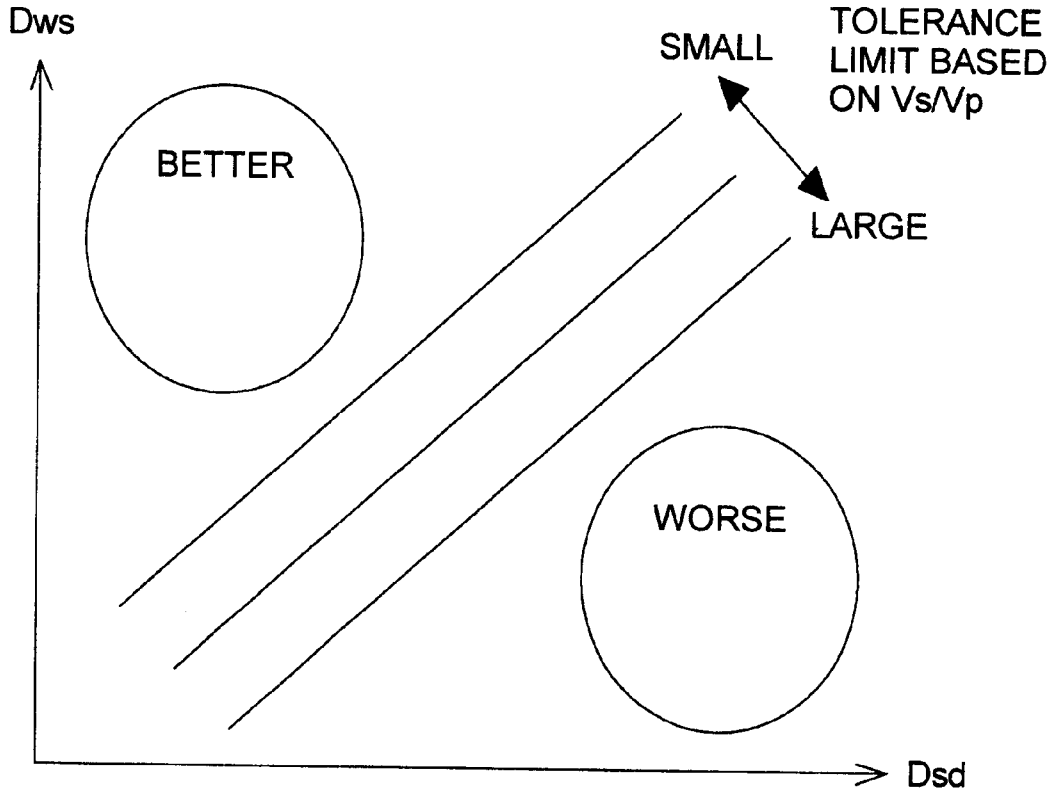
FIG. 1 is a diagram showing the relationship between a distance between an image carrier and a developing roller (Dsd (μm)) and an amount of conveyed developing agents (Dws (mg/cm$^2$).
Figure 2:
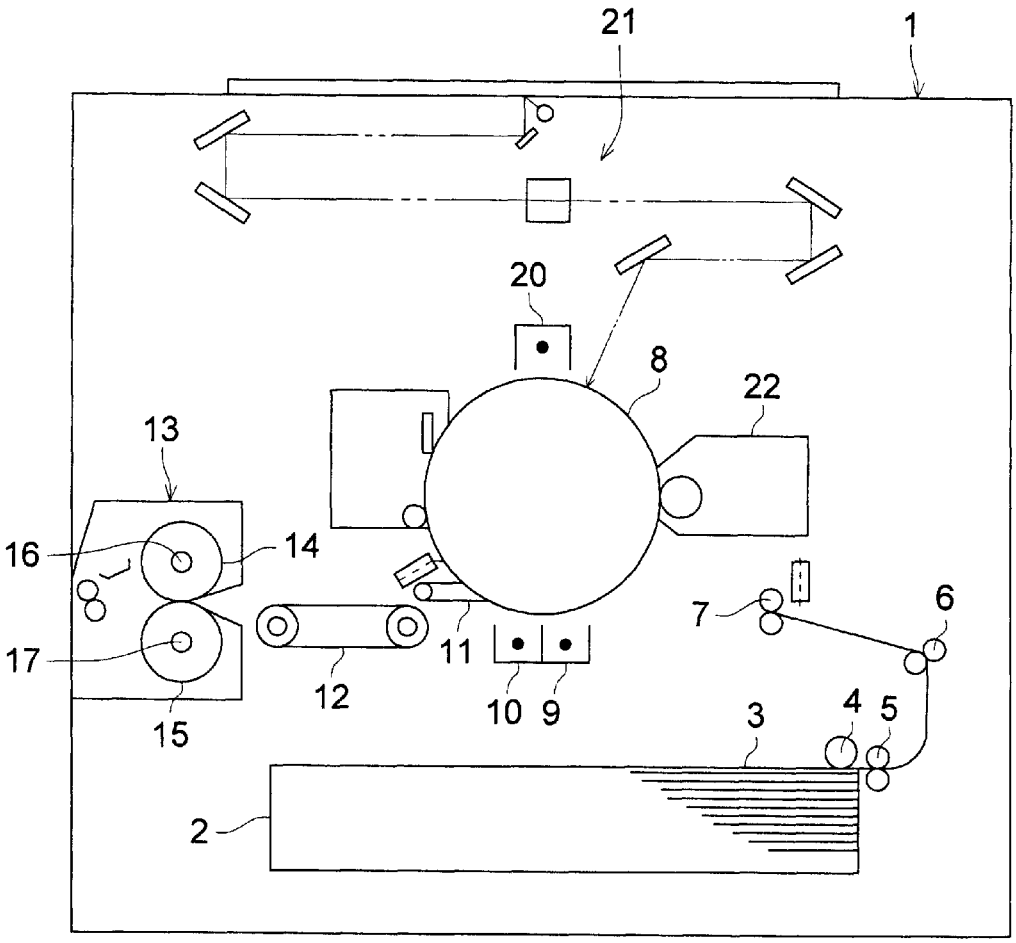
FIG. 2 is a schematic structure diagram of an image forming apparatus relating to the present embodiment.

An embodiment of the invention will be explained as follows, referring to the drawings. FIG. 2 is a schematic structure diagram of an image forming apparatus relating to the present embodiment. In image forming apparatus 1 in FIG. 2, transfer sheet 3 representing a transfer material to be loaded in sheet feed cassette 2 is fed out sheet by sheet by sheet feed roller 4 and double-feed preventing means 5. Due to that, transfer sheet 3 is guided by an unillustrated guide plate to be inserted in conveyance roller 6. Further, the transfer sheet 3 fed out of the conveyance roller 6 is inserted in registration roller 7 to be fed out to a transfer area in a transfer processing section.

Simultaneously with this, electric charges are given to the circumferential surface of photoreceptor drum 8 by charging unit 20, and then, image light is projected, through exposure system 21, on the circumferential surface of the photoreceptor drum 8 on which an electrostatic latent image is formed. By developing the electrostatic latent image with two-component developing agents supplied from developing unit 22, a toner image is formed on the circumferential surface of the photoreceptor drum 8.

After that, the transfer sheet 3 passes through the photoreceptor drum 8, transfer charger 9 and separation charger 10 to carry the toner image, and is placed on conveyance belt 12 through separation claw 11 to be fed into fixing section 13. The transfer sheet 3 is heated and pressed in the fixing section 13 so that the toner image is fixed thereon, and is conveyed to an unillustrated sheet ejection tray.

Figure 3:
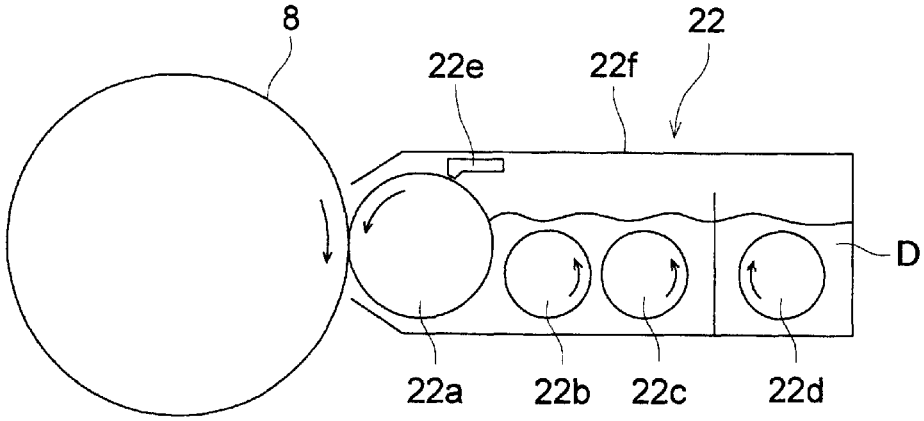
FIG. 3 is a diagram showing enlarged developing unit 22.

FIG. 3 is a diagram showing enlarged developing unit 22. In FIG. 3, a pair of developing agent conveyance screws 22*c* and 22*d* are arranged rotatably in casing 22*f* containing therein developing agents D, and supply roller 22*b* is arranged rotatably to be adjacent to the paired conveyance rollers. There is further arranged sleeve 22*a* representing a developing roller between photoreceptor drum 8 representing an image carrier and the supply roller 22*b*. Above the sleeve 22*a*, there is arranged development regulating plate 22*e* to be adjacent to the sleeve.

When the developing agent conveyance screws 22*c* and 22*d* are rotated, developing agents D are supplied to the vicinity of the supply roller 22*b* from an unillustrated developing agent reservoir section. The developing agents D are further supplied to the vicinity of the sleeve 22*a* by rotation of the supply roller, and when the sleeve 22*a* rotates, developing agents D in appropriate quantity corresponding to its rotating speed are supplied to the circumference of the photoreceptor drum 8 through the circumferential surface of the sleeve 22*a*.

Figure 4:
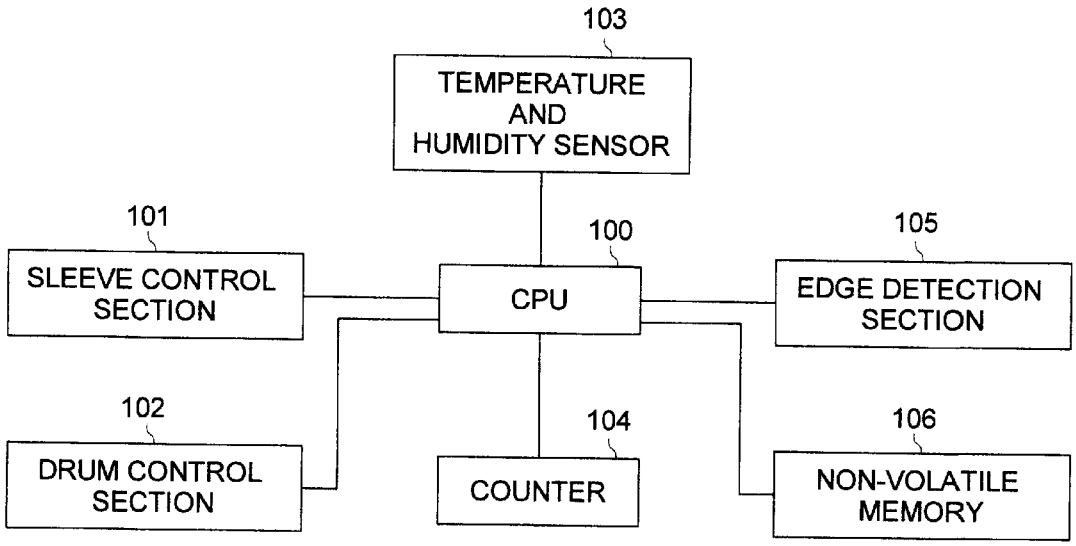
FIG. 4 is a block diagram showing a control system of the developing unit 22.

FIG. 4 is a block diagram showing a developing unit control system of an image forming apparatus related to the present embodiment. In FIG. 4, sleeve control section 101, drum control section 102 for controlling the rotating speed of photoreceptor drum 8, temperature and humidity sensor 103 that measures ambient temperature and humidity, counter 104 that detects the number of rotations of the sleeve 22*a* to obtain a sliding distance, edge detection section 105 and non-volatile memory 106 in which a change in an amount of conveyed developing agents is stored, are all connected to CPU 100 to be controlled individually.

How to repress rubbed images in an image forming apparatus of the present embodiment will be explained concretely. When sleeve control section 101 and drum control section 102 conduct rotation control to satisfy $$1<Vs/Vp\leqq 1.84 \quad (3)$$

for relative velocity (Vs/Vp) of sleeve 22*a* to photoreceptor drum 8, based on the expression (2) stated above, under the condition that specifications of developing unit 22 are made to represent the following, Distance between photoreceptor drum 8 and sleeve 22*a* (Dsd): 500 $\mu$m Initial amount of conveyed developing agents of sleeve 22*a* (Dws): 35 mg/cm$^2$, a rubbed image on the rear end portion of an image can be eliminated.

From the viewpoint that an amount of conveyed developing agents is lowered when a sliding distance of sleeve 22*a* is increased, it is preferable to change a Vs/Vp value. To be more concrete, a sliding distance of sleeve 22*a* is obtained by counter 104, and when the sliding distance is detected to have covered 6 km, for example, Dws value 30 mg/cm$^2$ (obtained experimentally in advance and stored as a table) after the change for sliding distance 6 km stored in non-volatile memory 106 is subjected to retrieval, and Dws value 30 mg/cm$^2$ after the change is substituted for Dws value 35 mg/cm$^2$ representing the initial amount of conveyed developing agents in the expression (2), thus, it is possible to obtain the following optimum Vs/Vp value.

$$1<Vs/Vp\leqq 2.15 \quad (4)$$

In this case, when the Vs/Vp value is changed, it is feared that the image density is changed from that before adjustment. Therefore, patch images each having different density are prepared on photoreceptor drum 8, then, each patch density is detected before and after adjustment, and developing Dc bias is subjected to feed back control so that the patch density after adjustment may be the same as that before the adjustment. Due to this, it is possible to repress a rubbed image on the rear end portion by establishing the Vs/Vp value that is optimum corresponding to the increased sliding distance, while preventing density change of the image.

On the other hand, an amount of conveyed developing agents varies depending on temperature and humidity. Therefore, when temperature/humidity sensor 103 for detecting temperature and humidity detects that temperature/humidity have changed from (20° C./30%) to (10° C./10%), for example, Dws value 40 mg/cm$^2$ (obtained experimentally in advance and stored as a table) in the case of (10° C./10%) is read out from Dws data corresponding to temperature/humidity stored in non-volatile memory 106, and Dws value 40 mg/cm$^2$ for (10° C./10%) is substituted for Dws value 35 mg/cm$^2$ for (20° C./30%) in the expression (2), thus, it is possible to obtain the following optimum Vs/Vp value.

$$1<Vs/Vp\leqq 1.61 \quad (5)$$

In the same way as in the occasion where the sliding distance of the sleeve 22*a* is increased, it is preferable that patch images each having different density are prepared on photoreceptor drum 8, then, each patch density is detected before and after adjustment, and developing Dc bias is subjected to feed back control so that the patch density after adjustment may be the same as that before the adjustment. Due to this, it is possible to repress a rubbed image on the rear end portion by establishing the optimum Vs/Vp value, while preventing density change of the image.

Figure 5:
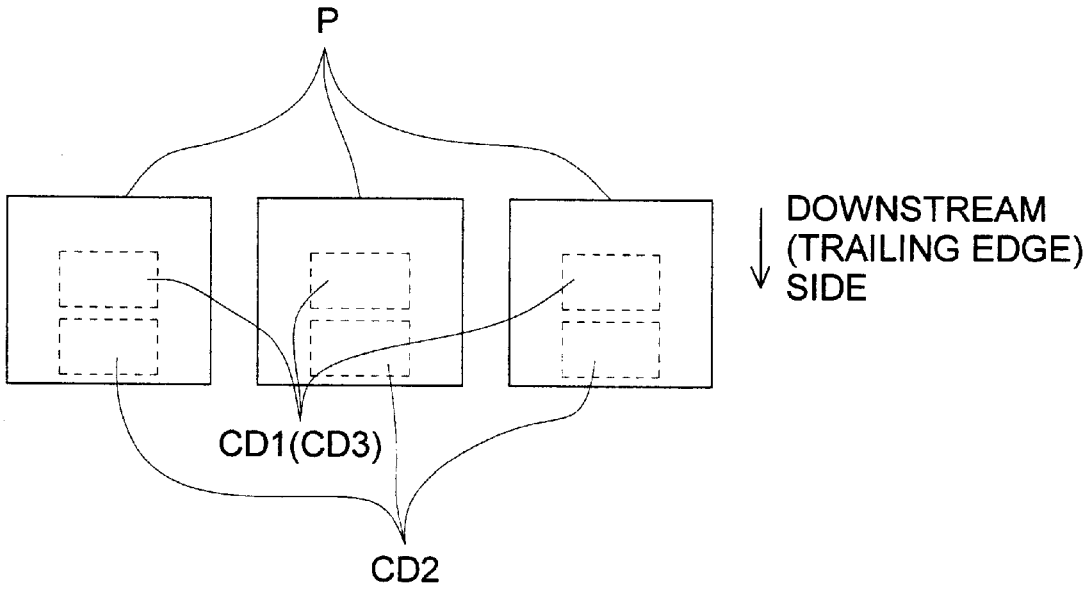
FIG. 5 is a diagram showing an example of a patch image.

With regard to an excessive edge effect or a rubbed image caused by a change in a conveying amount with the passage of time, for example, it is difficult to repress in the structure mentioned above. In the present embodiment, therefore, edge detecting section 105 is provided to conduct the following operations. Incidentally, a plurality of patch images (FIG. 5) each having different density are formed (even one patch image can be formed) on photoreceptor drum 8 based on document images in uniform density as preliminary preparations.

The edge detecting section 105 has an optical reading section, and scans patch image P formed on photoreceptor drum 8 to detect patch scan data corresponding to the density of the patch image. CPU 100 calculates image density mean value CD1 for a prescribed range on a central portion of the patch and image density mean value CD2 for a prescribed range on a rear portion of the patch from patch scan data, and when there is a density difference exceeding the following conditions, between the CD1 and CD2, $$CD1\times0.97\leqq CD2\leqq CD1\times1.03 \quad (6)$$

CPU 100 conducts feed back control on Vs/Vp so that CD1 and CD2 may be within the conditions above.

Further, the optical reading section of the edge detecting section 105 detects image density mean value CD3 for a prescribed range on a central portion of the patch after the feed back control, and when feed back control is conducted with developing DC bias so that CD3 and CD1 may be within the following conditions, $$CD1\times0.97\leqq CD3\leqq CD1\times1.03 \quad (7)$$

the excessive edge effect on the rear end portion of the image and the rubbed image on the edge can be improved, while the image density is maintained.

Incidentally, it is also possible to improve equally the excessive edge effect on the rear end portion of the image and the rubbed image on the edge by conducting feed back by the use of developing AC bias, developing AC frequency, Dsd value or Dws value, in place of Vs/Vp representing the object for feed back control. With regard to the image density in that case, it is possible to improve the excessive edge effect on the rear end portion of the image and the rubbed image on the edge while maintaining image density, by conducting feed back control with developing DC bias or an exposure value equally. With regard to feed back control with developing AC bias, developing AC frequency, developing DC frequency and an exposure value, explanation for them will be omitted because they are well aware.

Though the invention has been explained above, referring to the embodiments to which, however, the invention is not limited, and it is naturally possible to modify or improve them.

The invention makes it possible to provide an image forming apparatus wherein deterioration of image quality such as a rubbed image can be repressed.

What is claimed is:

1. An image forming apparatus comprising:

(a) an image carrier on which a latent image is formed; and (b) a developing roller provided in the vicinity of a surface of the image carrier for conveying a two-component developer to develop the latent image, wherein the following conditional inequality is satisfied, $$1<(Vs/Vp)\leqq(Dsd/Dws)\times0.129$$

where Vs/Vp represents a relative velocity of the developing roller to the image carrier, Dsd (gm) represents a distance between the surface of the image carrier and a surface of the developing roller, and Dws (mg/cm$^2$) represents an amount of the developer which has been held and conveyed by the developing roller.

2. The image forming apparatus of claim 1, wherein a sliding distance of the developing roller is counted, and the conveyance amount of the developer (Dws) is determined according to the sliding distance.

3. The image forming apparatus of claim 1, further comprising a temperature detector for detecting atmospheric temperature inside the apparatus, wherein the conveyance amount of the developer (Dws) is determined and controlled according to the temperature detected by the temperature detector.

4. The image forming apparatus of claim 1, further comprising a humidity detector for detecting atmospheric humidity inside the apparatus, wherein the conveyance amount of the developer (Dws) is determined and controlled according to the humidity detected by the humidity detector.

5. An image forming apparatus comprising:

(a) an image carrier on which a latent image is formed; and (b) a developing roller provided in the vicinity of a surface of the image carrier for conveying a two-component developer to develop the latent image toward the image carrier;

(c) a density detector for detecting a density of at least one patch image formed on the image carrier;

(d) a calculator for calculating a first image density data which indicates a density of a central portion of the patch image and a second image density data which indicates a density of a rear end portion of the patch image with respect to an advancing direction of the image carrier according to a detected result of the density detector; and (e) a controller for controlling a relative velocity (Vs/Vp) of the developing roller to the image carrier according to the first and second image density data so that the second image density data to the first image density data falls within a predetermined range.

6. The image forming apparatus of claim 5, wherein the density detector detects a plurality of patch images each having a different density that have been formed on the image carrier.

7. The image forming apparatus of claim 5, wherein the controller controls the relative velocity of the developing roller when a value of the second image density data to the first image density data indicates a state in which an edge of a rear end portion of the patch image shows an excessive edge effect or a rubbed image.

8. An image forming apparatus comprising:

(a) an image carrier on which a latent image is formed; and (b) a developing roller provided in the vicinity of a surface of the image carrier for conveying a two-component developer to develop the latent image toward the image carrier;

(c) a density detector for detecting a density of at least one patch image formed on the image carrier;

(d) a calculator for calculating a first image density data which indicates a density of a central portion of the patch image and a second image density data which indicates a density of a rear end portion of the patch image with respect to an advancing direction of the image carrier according to a detected result of the density detector; and (e) a controller for controlling a developing AC frequency or a developing AC bias to be applied to the developing roller so that the second image density data to the first image density data falls within a predetermined range.

9. The image forming apparatus of claim 8, wherein the density detector detects a plurality of patch images each having a different density that have been formed on the image carrier.

10. The image forming apparatus of claim 8, wherein the controller controls the developing AC frequency or the developing AC bias when a value of the second image density data to the first image density data indicates a state in which an edge of a rear end portion of the patch image shows an excessive edge effect or a rubbed image.

11. The image forming apparatus of claim 5, wherein after the controller controls the relative velocity of the developing roller to the image carrier, the calculator calculates a third image density data by detecting a density on the central portion of the patch image, and the image forming apparatus further comprises a second controller for controlling a developing DC bias to be applied to the developing roller or an exposure amount to form the latent image onto the image carrier so that the third image density data falls within a predetermined range with respect to the first image density data.

12. The image forming apparatus of claim 11, wherein the controller and the second controller are structured by a same CPU.

13. The image forming apparatus of claim 8, wherein after the controller controls the developing AC frequency or the developing AC bias, the calculator calculates a third image density data by detecting a density on the central portion of the patch image, and the image forming apparatus further comprises a second controller for controlling a developing DC bias to be applied to the developing roller or an exposure amount to form the latent image onto the image carrier so that the third image density data falls within a predetermined range with respect to the first image density data.

14. The image forming apparatus of claim 13, wherein the controller and the second controller are structured by a same CPU.

* * * * *